United States Patent [19]

Shimada

[11] Patent Number: 4,709,811

[45] Date of Patent: Dec. 1, 1987

[54] DEVICE FOR OPENING SEAL OF CIGARET PACKAGE AND PULLING OUT CIGARETS FROM THE PACKAGE

[75] Inventor: Katsuyuki Shimada, Takarazuka, Japan

[73] Assignee: Kinki Insatsu Kabushiki Kaisha, Osaka, Japan

[21] Appl. No.: 900,632

[22] Filed: Aug. 26, 1986

[30] Foreign Application Priority Data

Sep. 3, 1985 [JP] Japan ..... 60-134907[U]

[51] Int. Cl.[4] ..... B65D 85/10; B65D 5/54; B65D 17/34

[52] U.S. Cl. ..... 206/254; 206/264

[58] Field of Search ..... 206/249, 804, 264, 250, 206/253, 254, 255, 256

[56] References Cited

U.S. PATENT DOCUMENTS

| | | | |
|---|---|---|---|
| 381,889 | 4/1888 | Scott | 206/254 X |
| 1,132,781 | 3/1915 | Lile | 206/804 X |
| 1,928,663 | 10/1933 | Georger | 206/264 X |
| 1,951,343 | 3/1934 | Butt et al. | 206/264 X |
| 2,129,887 | 9/1938 | Tamarin | 206/250 X |
| 2,258,170 | 10/1941 | Austin et al. | 206/254 X |
| 2,415,117 | 2/1947 | Tamarin | 206/264 X |
| 2,453,777 | 11/1948 | Bell | 206/264 X |
| 2,675,169 | 4/1954 | Tamarin | 206/613 |
| 2,845,213 | 7/1958 | Tamarin | 206/264 X |
| 2,928,571 | 3/1960 | Caruso | 206/264 X |
| 3,260,405 | 7/1966 | Frischer et al. | 206/264 X |
| 3,923,239 | 12/1975 | Lee | 206/264 X |
| 4,444,308 | 4/1984 | MacEwen | 206/804 X |

FOREIGN PATENT DOCUMENTS

| | | | |
|---|---|---|---|
| 532051 | 10/1954 | Belgium | 206/254 |
| 676480 | 6/1939 | Fed. Rep. of Germany | 206/254 |
| 857778 | 7/1949 | Fed. Rep. of Germany | 206/254 |
| 67350 | 2/1958 | France | 206/254 |
| 190004 | 6/1937 | Switzerland | 206/254 |
| 195806 | 8/1938 | Switzerland | 206/254 |
| 207817 | 4/1940 | Switzerland | 206/254 |
| 780210 | 7/1957 | United Kingdom | 206/254 |

*Primary Examiner*—William Price

*Attorney, Agent, or Firm*—Wenderoth, Lind & Ponack

[57] ABSTRACT

This invention relates to a device for opening the seal of a cigaret package and pulling out cigarets from the package comprising an inserting piece integrally formed at the upper end with a cigaret base end contacting piece and a package seal opening and cigaret removing tongue piece and at the lower end with a cigaret end supporting piece, inserted into the cigaret package, a score line perforated on the upper surface of the package to cleave the sewing line line by the base end contacting piece erected by pulling up the tongue piece, to simply open the seal of the package in one step. And by further pulling up the tongue piece, the inserting piece is further withdrawn from the package, thus pulling out the cigarets at the seal opening time.

12 Claims, 15 Drawing Figures

DEVICE FOR OPENING SEAL OF CIGARET PACKAGE AND PULLING OUT CIGARETS FROM THE PACKAGE

BACKGROUND OF THE INVENTION

This invention relates to a device for opening the seal of a cigaret package and pulling out cigarets from the package and, more particularly, to a structure for simply opening the sealing of a package so as to readily pull out one or more cigarets from the cigaret package.

PRIOR ART

Heretofore, a conventional cigaret package is sealed by folding the upper portions of both lateral right and left sides of a moistureproof packaging sheet of rectangular shape, then the upper portions of longitudinal front and rear sides so as to coat the upper surfaces of cigarets, and bonding an enclosing seal over the upper ends of a sheath such as printed with the trade name of the package on the central portion of the upper folded portion of a longitudinal strip or band.

When a user opens the seal of the cigaret package, he ordinarily opens either one of right and left sides of the seal for enclosing the package by inserting the end of the finger into the lower portion of the folded part of the upper portion of the longitudinal strip or band, then breaking the folded part of the upper portion along the seal, and then erecting the folded part of the upper end of the strip and the folded part of the upper end of the lateral strip or band, thereby opening the seal of the package. This opening operation of the package is complicated. Even when one or more cigarets are pulled out from the opened package, the tops of the cigarets cannot be held or grasped directly by the fingers to pull out the cigarets. Then, the bottom of the package is struck by the finger end to project the upper ends of the cigarets, and one or more the cigarets are then removed from the package. Thus, there is difficulty in removing one of the cigarets from the package.

Moreover, the device for opening the seal of a cigaret package and pulling out cigarets from the package is, disclosed in U.S. Pat. Nos. 2,675,169 and 2,415,117. All that is disclosed by the former is a device for opening the seal of a cigaret package by tearing the upper portion of a cellulose film cover and by pulling out a strip adhered thereto to open either the revenue stamp of a flap or the side end of a sticker. The former patent is not equipped with a device for pulling out cigarets from their package and a user feels inconvenienced when he pulls out the cigarets. In the latter patent, on the other hand, a strip adhered to the side of each cigaret can be pulled out to open the side end of the revenue stamp of a flap, as in the former U.S. patent, so that the cigarets can be pulled out. Since the strips are adhered to the sides of the cigarets, however, in dependence upon the strength of the adhesion, the strips may be peeled out, when pulled out, from the sides of the cigarets before the cigarets are pulled out, or alternatively the cigaret sides may be torn by the strips being pulled out. This makes the latter device undesirable in that only the strips are pulled out to leave their cigarets in the package or in that the cigarets pulled out are torn at their sides when they are to be cleared of their strips, even if the cigarets per se can be pulled out.

SUMMARY OF THE INVENTION

It is therefore an object of the present invention to provide a device for simply removing one or more cigarets from a cigaret package by eliminating the abovementioned disadvantages and drawbacks of the conventional cigaret package and for readily opening the package and removing one or more cigarets from the opened seal of the package.

In order to achieve the above object of this invention, there is provided a device for opening the seal of a cigaret package and pulling out cigarets from the package comprising an inserting piece having substantially the same shape and size as those of the right and left sides of the package, formed with four longitudinal lines to be bent in a groove shape, and integrally formed at the lower end of the central bottom piece with a cigaret end supporting piece necked at both sides at the center and at the upper end of the bottom piece with a cigaret base end contacting piece, and at the end of the contacting piece with a package seal opening and cigaret removing tongue piece.

When the inserting piece is packed together with cigarets in the package, the inserting piece formed with the groove is contacted with either one of the right and left sides of suitable number of cigarets, the cigaret end supporting piece and the cigaret base end contacting piece are respectively contacted with the ends and the base ends of the cigarets, while the tongue piece is being erected from the contacting piece, the front and rear sides, the right and left peripheral sides and the bottom are enclosed by the packaging sheet, the upper ends of the right and left sides of the sheet thus sealed are folded, the tongue piece is bent on the upper end of either side of the right and left sides thus folded, the upper ends of the front and rear sides of the sheet are folded from above, a score line is perforated at the upper ends of the front and rear sides disposed at the base end of the tongue piece, and a sealing strip is bonded over the front and rear sides of the sheath of the package at the center of the upper end of the front and rear sides thus folded to seal the package.

When the package thus sealed is opened, a fingertip is engaged with the end of the tongue piece sidewise projected from the upper ends of the bent front and rear sides of the package, and the tongue piece is erected from the contacting piece. Then, the packaging sheet of the upper end of the front and rear sides is cloven along the score lines. When the tongue piece is further pulled up, the contacting piece is erected on the inserting piece, the upper end of either side of the right and left sides and the upper end of the front and rear sides of the score line side are erected to readily open the seal of the package.

When one or more cigarets are then pulled out from the package, the tongue piece is further pulled up to remove the inserting piece from the package. Then, the cigarets supported on the supporting piece are simply projected at the base ends from the package to readily pull out the cigarets.

BRIEF DESCRIPTION OF THE DRAWINGS

FIGS. 2A and 2B are perspective views showing a first embodiment of a device for opening the seal of a cigaret package and pulling out cigarets from the package according to this invention illustrating the seal opening sequence of the package, wherein FIG. 2A shows the state that a score line of a sealed section is cloven, and FIG. 2B shows the opened state;

FIGS. 3A and 3B are perspective views showing the state one or more cigarets are being pulled, wherein FIG. 3A is a front view, and FIG. 3B is a back view;

FIGS. 10 to 12 are views showing a second embodiment of the invention in which a blade piece is folded forward: wherein FIG. 10 is a perspective view of the inserting piece; FIG. 11 is a bottom view of the essential portion illustrating the state that cigarets are placed on a cigaret end supporting piece; and FIGS. 12A and 12B are perspective views at cigaret removing time, wherein FIG. 12A is a front view, and FIG. 12B is a back view.

DESCRIPTION OF THE PREFERRED EMBODIMENTS

Embodiments of this invention will be described in detail with reference to the accompanying drawings.

Figure 5:
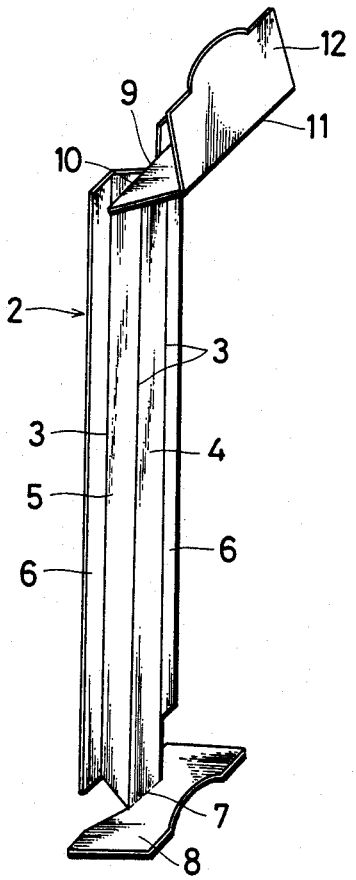
FIG. 5 is a perspective view of the inserting piece, and a seal opening and cigaret removing device.
Figure 6:
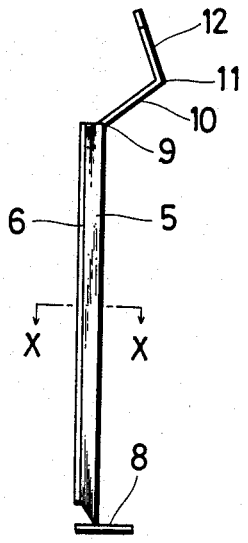
FIG. 6 is a side view of FIG. 5.
Figure 7:
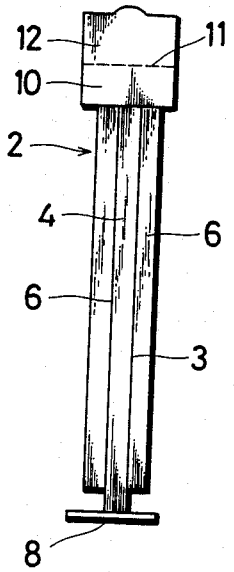
FIG. 7 is a front view of FIG. 5.
Figure 8:
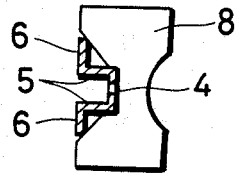
FIG. 8 is a sectional view taken along the line X—X in FIG. 6.
Figure 9:
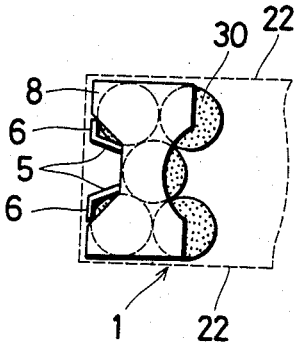
FIG. 9 is a bottom view of the essential portion showing the state that cigarets are placed on a cigaret end supporting piece.
Figure 10:
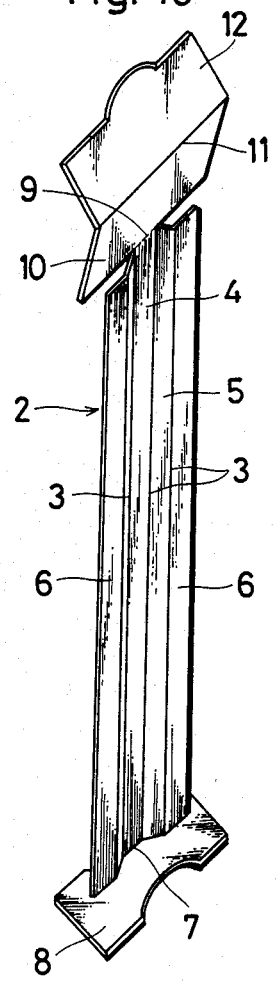
Figure 11:
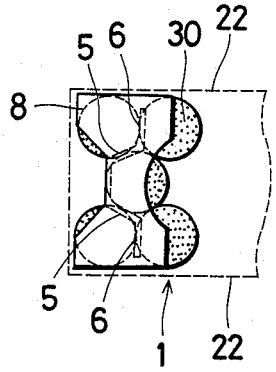

In FIGS. 1 to 9, reference numeral 1 designates a known cigaret package in which twenty cigarets 30 are enclosed at the side periphery by a moistureproof packaging sheet in a rectangular parallelpiped shape, sealed at the bottom, and formed at the upper rectangular sectional portion in such a manner that the upper parts 20*a* and 20*a* of the right and left sides 20 and 20 of the upper rectangular-sectional portion are inwardly folded in contact with the top surfaces of the cigarets 30, the upper parts of the front and rear sides 22 and 22 of the rectangular-sectional portion are folded in a trapezoidal shape, and the trapezoidal parts 22*a* and 22*a* are sequentially folded and superposed on the upper surfaces of the upper parts 20*a* and 20*a* of the right and left sides 20 and 20 of the packaging sheet inwardly folded; a sheath printed with a trade name of the cigaret is bonded on the side periphery except the upper surface of the package 1, and a sealing strip or band 24 known per se is bonded on the upper ends of the front and rear sides of the sheath at the center of the upper surfaces of the trapezoidal parts 22*a* and 22*a*. Reference numeral 2 designates an inserting piece of substantially the same shape and size as those of the side 20 of the package 1 for enclosing the cigarets, formed with four longitudinal folding lines 3, 3, 3 and 3 to be bent in a groove shape with central bottom piece or central piece 4, side pieces 5 and 5, and blade pieces 6 and 6. In this case, as shown in FIG. 5, the central bottom piece may be arbitrarily selectively bent to be inwardly projected or, as shown in FIG. 10, bent to be inwardly recessed. In this embodiment, the central piece 4 has a width capable of being inserted into the central gap between the sides of twenty cigaret array known per se, and the side pieces 5 and 5 and the blade pieces 6 and 6 have a width substantially half of the diameter of a cigaret. Reference numeral 8 designates a cigaret end supporting piece necked at both sides of the center integrally formed at the lower end of the bottom piece 4 through a folding line 7 and placed to support the end of five cigarets at the left side end of the package 1 as shown in FIG. 9 or 11. Reference numeral 10 designates a cigaret base end contacting piece integrally formed at the upper end with the bottom piece 4 through a folding line 9, and reference numeral 12 designates a package seal opening and cigaret removing tongue piece integrally formed at the end with the contacting piece 10 through a folding line 11. The contacting piece 10 and the tongue piece 12 are formed substantially in the same length as the length from the sealing strip 24 to the side end of the package 1. Reference numerals 23 and 23 designate score lines formed at the upper trapezoidal parts 22*a* and 22*a* of the front and rear sides 22 and 22 of the package 1, and perforated along the portion disposed above the folding line 11 of the base end of the tongue piece 12, i.e., the sealing strip 24.

When the inserting piece 2 is packed together with twenty cigaret array 30 in the package, the piece 2 is bent at four longitudinal folding lines 3, 3, 3 and 3 in a groove shape as shown in FIGS. 5 and 10. The central bottom piece or central piece 4 is then inserted into the central gap between the left sides of twenty cigaret 30 array as shown in FIGS. 9 and 11, the supporting piece 8 and the contacting piece 10 are respectively contacted with the ends and the base ends of the cigarets 30, the twenty cigaret array 30 is sealed at the side periphery and the bottom, and while the tongue piece 12 is being erected from the contacting piece 10, the upper parts 20*a* and 20*a* of the right and left sides 20 and 20 of the packaging sheet are inwardly folded, the tongue piece 12 is bent and superposed on the upper parts 20*a* of the left side 20, the trapezoidal parts 22*a* and 22*a* of the front and rear sides 22 and 22 of the packaging sheet are bent and superposed on the tongue piece 12 and the upper parts 20*a* of the right side 20, the sheath and the sealing strip 24 are bonded at the predetermined portions known per se and sealed as a package 1.

Figure 1:
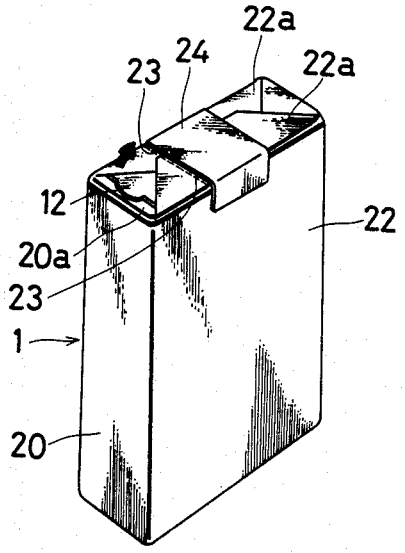
FIG. 1 is a perspective view of a cigaret package at its sealing time.
Figure 2A:
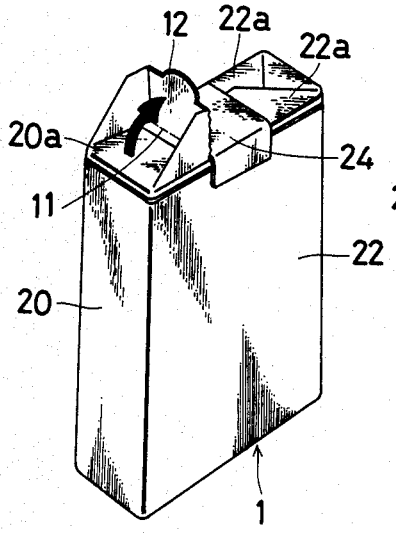

When the package 1 thus sealed as described above is opened, the end of the package seal opening and cigaret removing tongue piece 12 projected from the side ends of the trapezoidal parts 22*a* and 22*a* of the front and rear sides 22 and 22 of the package is pulled upward by the fingertip. Then, the tongue piece 12 is erected at the folding line 11 as shown in FIG. 2A, and the score lines 23 and 23 perforated at the upper parts 22*a* and 22*a* are cloven. Then, when the tongue piece 12 is picked up and the contacting piece 10 is erected, the upper part 20*a* of the left side 20 bent on the contacting piece 10 and the upper parts 22*a* and 22*a* of the front and rear sides 22 and 22 of the score lines 23 and 23 side are readily erected and opened as shown in FIG. 2B.

Figure 2B:
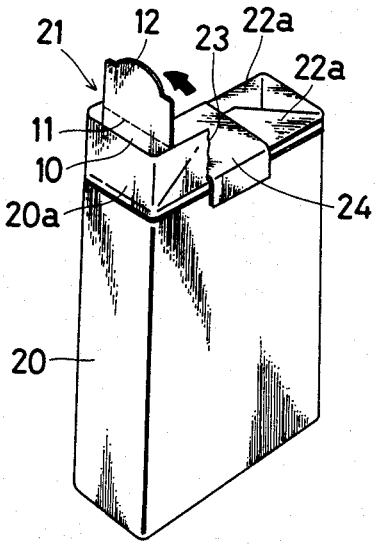
Figure 3A:
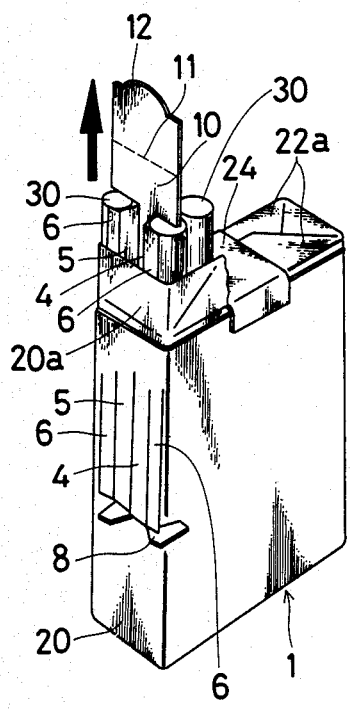
Figure 3B:
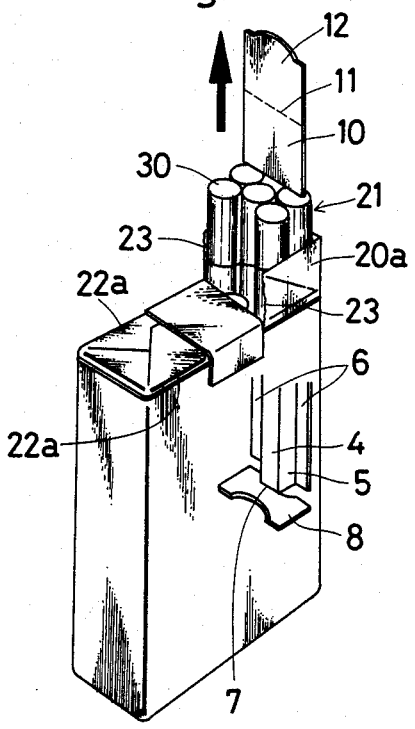
Figure 4:
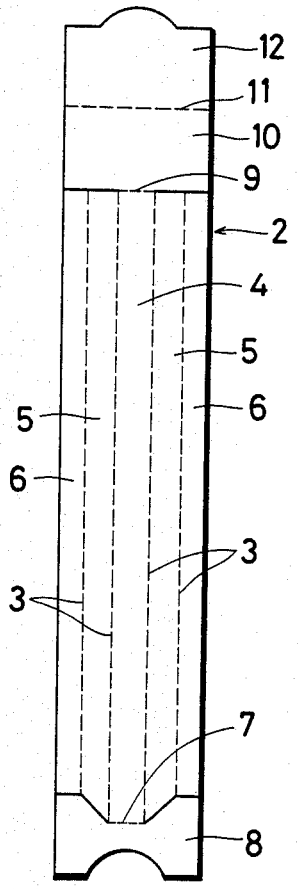
FIG. 4 is a developed view of an inserting piece.
Figure 12A:
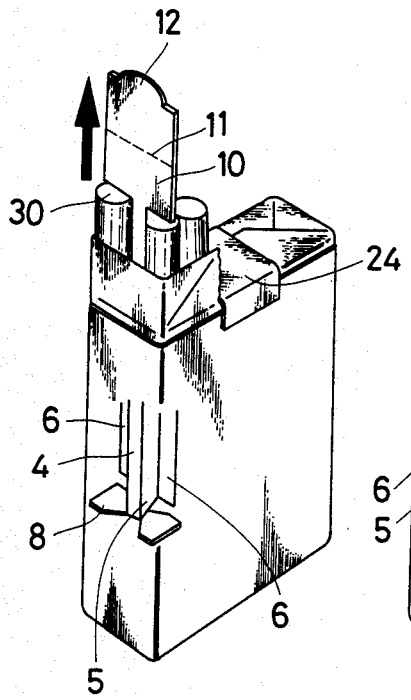
Figure 12B:
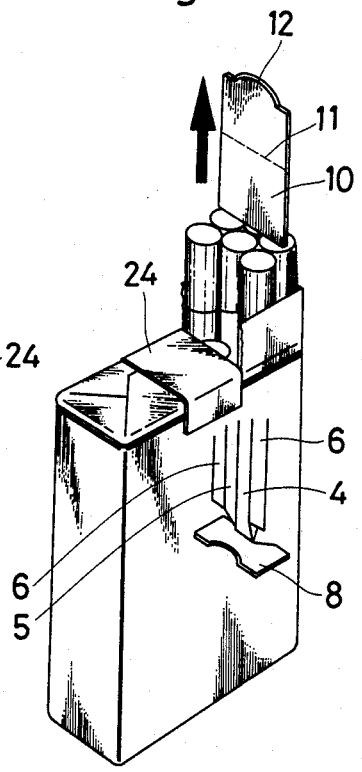

When one or more cigarets 30 are further removed from the package, the tongue piece 12 is further pulled up from the position shown in FIG. 2B. Then, the cigarets 30 placed at the ends on the supporting piece 8 are lifted as shown in FIGS. 3 and 12, and five cigarets 30 placed to be supported on the supporting piece 8 are readily pulled out of the opened seal 21 of the package 1 as shown in FIG. 3B or 12B. Thus, the complexity found heretofore at the cigaret removing time can be eliminated.

When the cigarets 30 are initially pulled out, two cigarets at the side of the package 1 are disturbed to be removed by the contacting piece 10 as shown in FIG. 3 or 12, but inside three cigarets are preferably initially removed from the side end. After the cigarets are sequentially removed one by one, the tongue piece 12 is pulled out from the package 1 at a suitable time, then damaged, and may be removed in the same manner as the conventional package.

What is claimed is:

1. A device for opening the seal of and for pulling out cigarets from a cigaret package of the type enclosed by a folded packaging sheet having score line on the top thereof, the device comprising:

an inserting piece having upper and lower ends;

a cigaret base end contacting piece for contacting the bases of cigarets and integrally connected at the upper end of said inserting piece;

a package seal opening and cigaret removing tongue piece integrally connected to said cigaret base end contacting piece;

a cigaret end supporting peice integrally connected to the lower end of said inserting piece;

said inserting peice having a central piece substantially at a central portion thereof;

a pair of said peices, each one of said pair of blade pieces integrally conected to a respective side of said central piece;

a pair of blade pieces, each one of said pair of blade pieces integrally connected to a respective side of said central piece;

said cigaret end supporting piece being substantially centrally connected to said central piece, said cigaret end supporting piece being necked at the connection to said central piece, said cigaret end supporting piece being substantially horizontally disposed in the cigaret package when said inserting piece is substantially vertically disposed in the cigaret package;

said central piece, said pair of side peices, and said pair of blade peices substantially extending the width of the cigaret package, whereby said cigaret end supporting piece supports an odd number of cigarets greater than or equal to five, whereby the pair of side pieces and the pair of blade pieces support and urge the central piece centrally of the package, thereby ensuring that the central piece remains centrally located and assures positive pulling out of the at least five cigarets from the package.

2. The device of claim 1, wherein the integral connections betwen said cigaret base end contacting piece and said inserting piece, between said cigaret removing tongue piece and said cigaret base end contacting piece, and between said cigaret end supporting piece and said inserting piece comprise fold lines.

3. The device of claim 2, wherein the integral connections between said pair of side pieces and said central piece, and between said pair of blade pieces and said pair of side pieces, comprise fold lines.

4. The device of claim 1, wherein said cigaret end supporting piece supports the odd number of cigarets greater than or equal to five such that one of the at least five cigarets is supported centrally of the cigaret package adjacent said central piece and the other cigarets are supported in equal numbers on opposite sides of said central piece, whereby the at least one cigaret is urged centrally of the cigaret pack by both the other cigarets and by said pairs of side and blade pieces.

5. The device of claim 1, wherein said central piece, said pair of side pieces, and said blade pieces have an omega-shaped cross-section.

6. A cigaret package of the type enclosed by a folded packaging sheet having a score line on the top thereof, said cigaret package comprising:

a device for opening the seal of and for pulling out cigarets from said cigaret package; said device further comprising:

an inserting piece having upper and lower ends;

a cigaret base end contacting piece for contacting the bases of cigarets and integrally connected at the upper end of said inserting piece;

a package seal opening and cigaret removing tongue piece integrally connected to said cigaret base end contacting piece;

a cigaret end supporting piece integrally connected to the lower end of said inserting piece;

said inserting piece having a central piece substantially at a central portion thereof;

a pair of side pieces, each one of said pair of side pieces integrally connected to a respective side of said central piece;

a pair of blade pieces, each one of said pair of blade pieces integrally connected to a respective one of each said side pieces;

said cigaret end supporting piece being substantially centrally connected to said central piece, said cigaret end supporting piece being necked at the connection to said central piece, said cigaret end supporting piece being substantially horizontally disposed in the cigaret package when said inserting piece is substantially vertically disposed in the cigaret package;

said central piece, said pair of side pieces, and said pair of blade pieces substantially extending the width of the cigaret package, whereby said cigaret end supporting piece supports an odd number of cigarets greater than or equal to five, whereby the pair of side pieces and the pair of blade pieces support and urge the central piece centrally of the package, thereby ensuring that the central piece remains centrally located and assures positive pulling out of the at least five cigarets from the package.

7. The cigaret package of claim 6, the integral connections between said cigaret removing tongue piece and said cigaret base end contacting piece, and between said cigaret end supporting piece and said inserting piece comprise fold lines.

8. The cigaret package of claim 7, wherein the integral connections between said pair of side pieces and said central piece, and between said pair of blade pieces and said pair of side pieces, comprise fold lines.

9. The cigaret package of claim 6, wherein said cigaret end supporting piece supports the odd number of cigarets greater than or equal to five such that one of the at least five cigarets is supported centrally of the cigaret package adjacent said central piece and the other cigarets are supported in equal numbers on opposite sides of said central piece, whereby the at least one cigaret is urged centrally of the cigaret pack by both the other cigarets and by said pairs of side and blade pieces.

10. The cigaret package of claim 6, wherein said central piece, said pair of side pieces, and said blade pieces have on omega-shaped cross-section.

11. The cigaret package of claim 6, wherein said base end contacting piece and said tongue piece are interposed between said folded packaging sheet and said cigaret package at the top thereof.

12. The cigaret package of claim 6, wherein the fold line between said cigaret base end contacting piece and said tongue is at a distance from the free end of said tongue, the distance being substantially equal to the distance between the score line in the packaging sheet on the top of the cigaret package and one of the top edges of the package.

* * * * *